US006219851B1

(12) United States Patent
Fang

(10) Patent No.: US 6,219,851 B1
(45) Date of Patent: Apr. 24, 2001

(54) RING-BAND ADJUSTMENT STRUCTURE OF CRUSH HELMET

(76) Inventor: Kuo-Yun Fang, 7F, No. 10-2, Tien Mu North Road, Shin Lin District, Taipei (TW)

( * ) Notice: Subject to any disclaimer, the term of this patent is extended or adjusted under 35 U.S.C. 154(b) by 0 days.

(21) Appl. No.: 09/371,850

(22) Filed: Aug. 11, 1999

(51) Int. Cl.[7] ..... A42B 3/04
(52) U.S. Cl. ..... 2/418
(58) Field of Search ..... 2/8, 9, 417, 418, 2/419, 420, 195.2, 195.3, 195.4, 183, DIG. 11; 24/68 R, 68 B, 271, 272, 274 R, 274 WB

(56) References Cited

U.S. PATENT DOCUMENTS 2,550,575 * 4/1951 Malcom ..... 2/8
3,041,622 * 7/1962 Gurtowski ..... 2/8
3,079,609 * 3/1963 Hoffmaster ..... 2/8
3,090,046 * 5/1963 Bowers, Sr. ..... 2/8
3,325,824 * 6/1967 Donegan ..... 2/8
5,357,654 * 10/1994 Hsing-chi ..... 24/68 B
5,950,245 * 9/1999 Binduga ..... 2/417

* cited by examiner

*Primary Examiner*—Michael A. Neas
(74) *Attorney, Agent, or Firm*—Rosenberg, Klein & Lee

(57) ABSTRACT

A ring-band adjustment structure of the crash helmet comprises a ring-band, a connection part and two adjustment parts. The accommodation groove of the connection part has two rows of positioning teeth with their teeth end on the top side. The two adjustment parts are connected to the two ends of the ring-band. The two adjustment parts are slid to match the positioning teeth. The two adjustment parts can be in the lock state or the adjustment state. The diameter of the ring-band can be adjusted properly according to the head of the user, resulting in steady positioning and comfortable wear. Simple structure and easy assembly make the production cost be reduced greatly.

4 Claims, 11 Drawing Sheets

RING-BAND ADJUSTMENT STRUCTURE OF CRUSH HELMET

FIELD OF THE INVENTION

The present invention relates to a ring-band adjustment structure of the crash helmet, more particularly, to a ring-band adjustment structure with an adjustable ring5 band, and of simple structure and easy assembly.

BACKGROUND OF THE INVENTION

The conventional crash helmet worn when riding a bicycle has a ring-band installed inside to fix on the head of the user. The diameter of the ring-band is fixed and can not be adjusted properly according to the head of the user, resulting in unsteady positioning and uncomfortable wear.

The primary object of the present invention is to provide a ring-band adjustment structure of the crash helmet, which comprises a ring-band, a connection part and two adjustment part. The accommodation groove of the connection part has two positioning teeth with their teeth end on the top side. The two adjustment parts are connected to the two ends of the ring-band. The two adjustment parts are slid to match the position teeth. The two adjustment parts can be in the lock state or the adjustment state. The diameter of the ring-band can be adjusted properly according to the head of the user, resulting in steady positioning and comfortable wear. Moreover, the positioning teeth are formed on the connection part. Simple structure and easy assembly thus make the production cost be reduced greatly.

The various objects and advantages of the present invention will be more readily understood from the following detailed description when read in conjunction with the appended drawing, in which:

DETAILED DESCRIPTION OF PREFERRED EMBODIMENT

Figure 8:
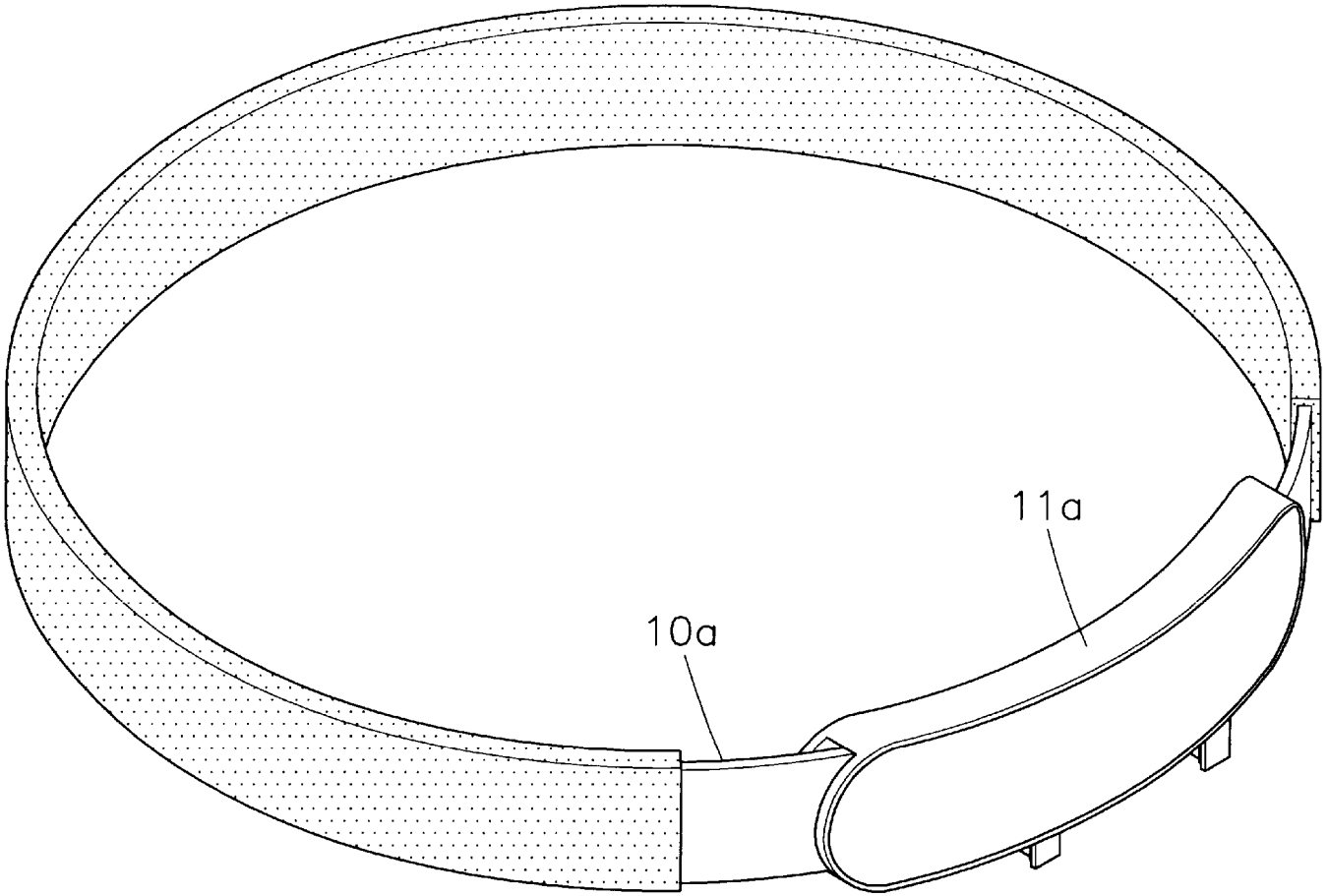
FIG. 8 PRIOR ART
FIG. 8 is the assembly diagram of the conventional ring-band adjustment structure.
Figure 9:
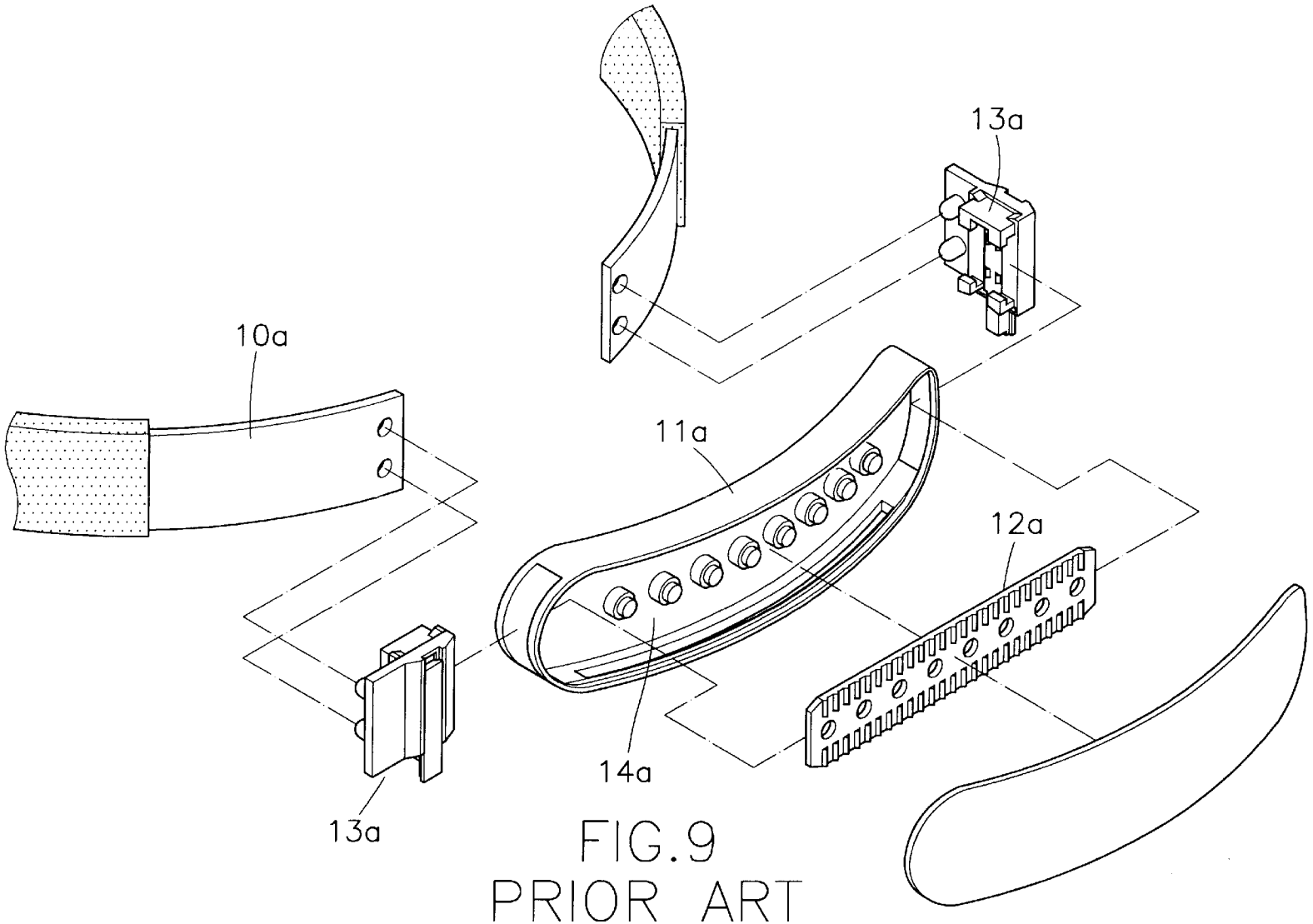
FIG. 9 PRIOR ART
FIG. 9 is the disassembly diagram of the conventional ring-band adjustment structure.

As shown in FIGS. 8 and 9, the conventional ring-band adjustment structure of the crash helmet comprises a ring-band 10*a*, a connection part 11*a*, a positioning component 12*a*, and two adjustment parts 13*a*. The positioning component 12*a* is matched inside the accommodation groove 14*a* of the connection part 11*a*. The two adjustment parts 13*a* are connected to the two ends of the ring-band 10*a* and are slid to match the positioning component 12*a*. The two adjustment parts 13*a* can be in the lock state or the adjustment state. The diameter of the ring-band 10*a* can be adjusted properly according to the head of the user, resulting in steady positioning and comfortable wear. However, the structure is complex, and it takes time and effort to install the positioning component 12*a* inside the accommodation groove 14*a*. The assembly is thus bothersome, resulting in higher production cost.

As shown in FIGS. 1, 2, 3*a*, 3*b*, and 3*c*, the ring-band adjustment structure of the crash helmet of the present invention comprises a ring-band 10, a connection part 20, and two adjustment parts 30. The ring-band 10 is a band made of plastic material with a appropriate length and is bent to form a ring. The ring-band has two connection holes 11 on each ends. The ring-band can also be enclosed by an enclosing body 50 made of soft material to increase wearing comfort.

The connection part 20 is of arc form and has a accommodation groove 21 installed in the concave front side. The accommodation groove 21 has a left and a right positioning teeth 22 installed along the longitudinal direction. The teeth end of the positioning teeth 22 is on the top side. The positioning teeth 22 can also have unidirectional lock function. The connection part 20 has a left and a right slit 23 installed along the longitudinal direction on the bottom side. The connection part 20 has a hole 24 on each end. The accommodation groove 21 can be connected outward through the slit 23 and the hole 24.

The adjustment part 30 has two connection poles 31 installed on the back side, corresponding to the connection holes 11 of the ring band 10. The adjustment part 30 has a first sliding groove 32 in the vertical direction. A sliding clump 33 is slid to match the first sliding groove 32 and can be slid upward and downward. The sliding clump 33 has an elastic component 34 on the top side to elastically push the sliding clump 33 downward. The sliding clump 33 has a pawl 35 installed on the back side. The adjustment part 30 has a second sliding groove 36 in the horizontal direction installed on the back side to be slid to match the positioning teeth 22 of the connection part 20. A cover plate 37 can be embedded fixedly on the front side of the first sliding groove 32 to close the front open of the first sliding groove 32. This can prevent the sliding clump 33 and the elastic component 34 to run out of the first sliding groove 32. The adjustment part 30 joins with a push button 38 on the front side. The push button 38 has a join pole 39 on the back side to link with the join hole 39*a* on the front side of the adjustment part 30. The push button 38 is situated outside the accommodation groove 21.

When assembled, the connection poles 31 of the two adjustment parts 30 are connected to the connection holes 11 of the ring-band 10 to link fixedly the two adjustment parts with the two ends of the ring-band. The two adjustment parts 30 are inserted to match the accommodation groove 21 through the holes 24 on the two ends of the connection part 20. The second sliding groove 36 of the two adjustment parts are slid to match the top and bottom sides of the positioning teeth 22. The bottom end of the sliding clump 33 protrudes out of the connection part through the slit 23. A cover body 40 can be locked or bound on the front open of the accommodation groove 21. The cover body 40 has a left and a right slit 41 along the longitudinal direction to let the join pole 39 of the push button 38 traverse the slit 41 to link with the join hole 39*a* on the front side of the adjustment part 30.

Figure 6:
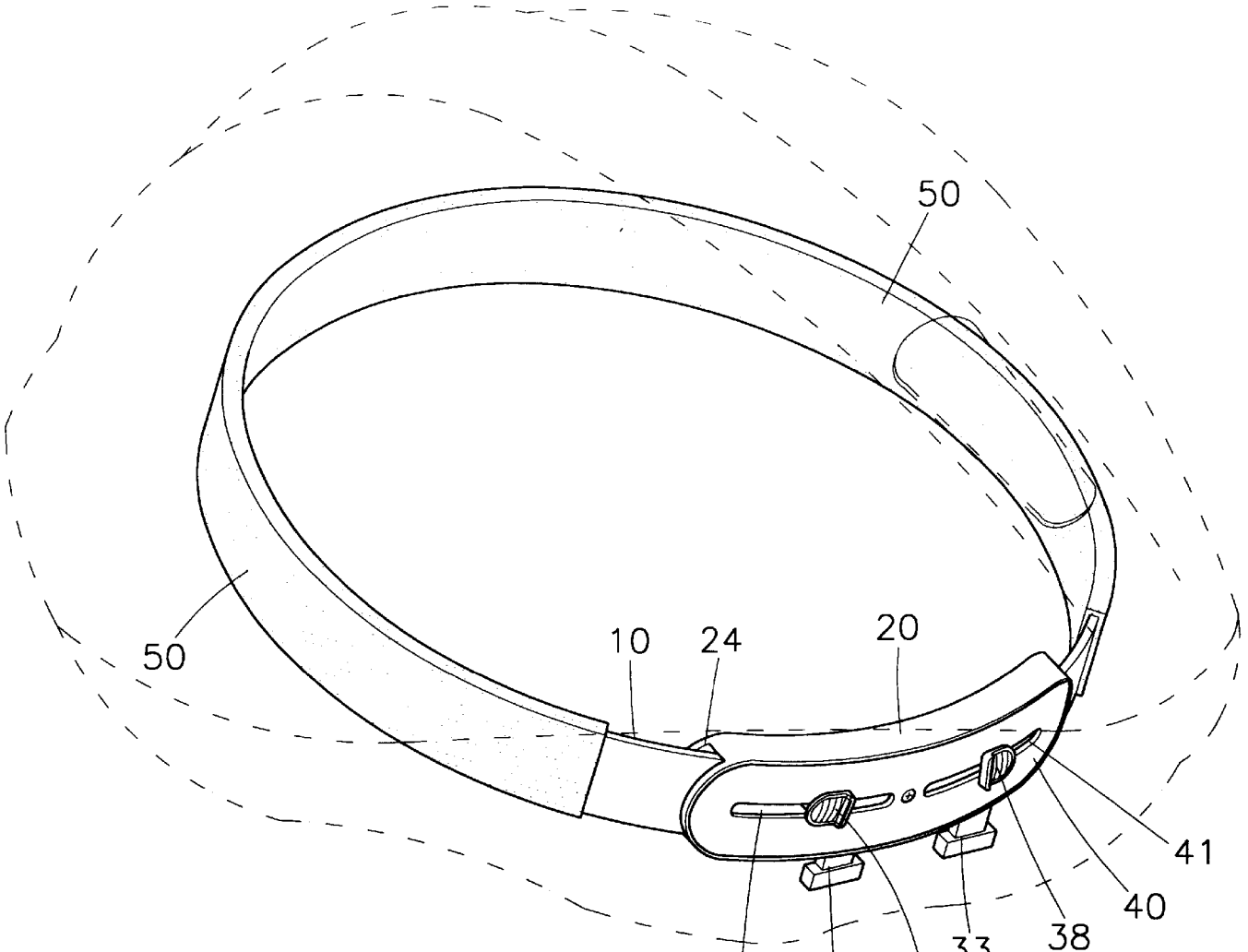
FIG. 6 is the diagram showing an usage of the ring-band adjustment structure of the present invention.
Figure 7:
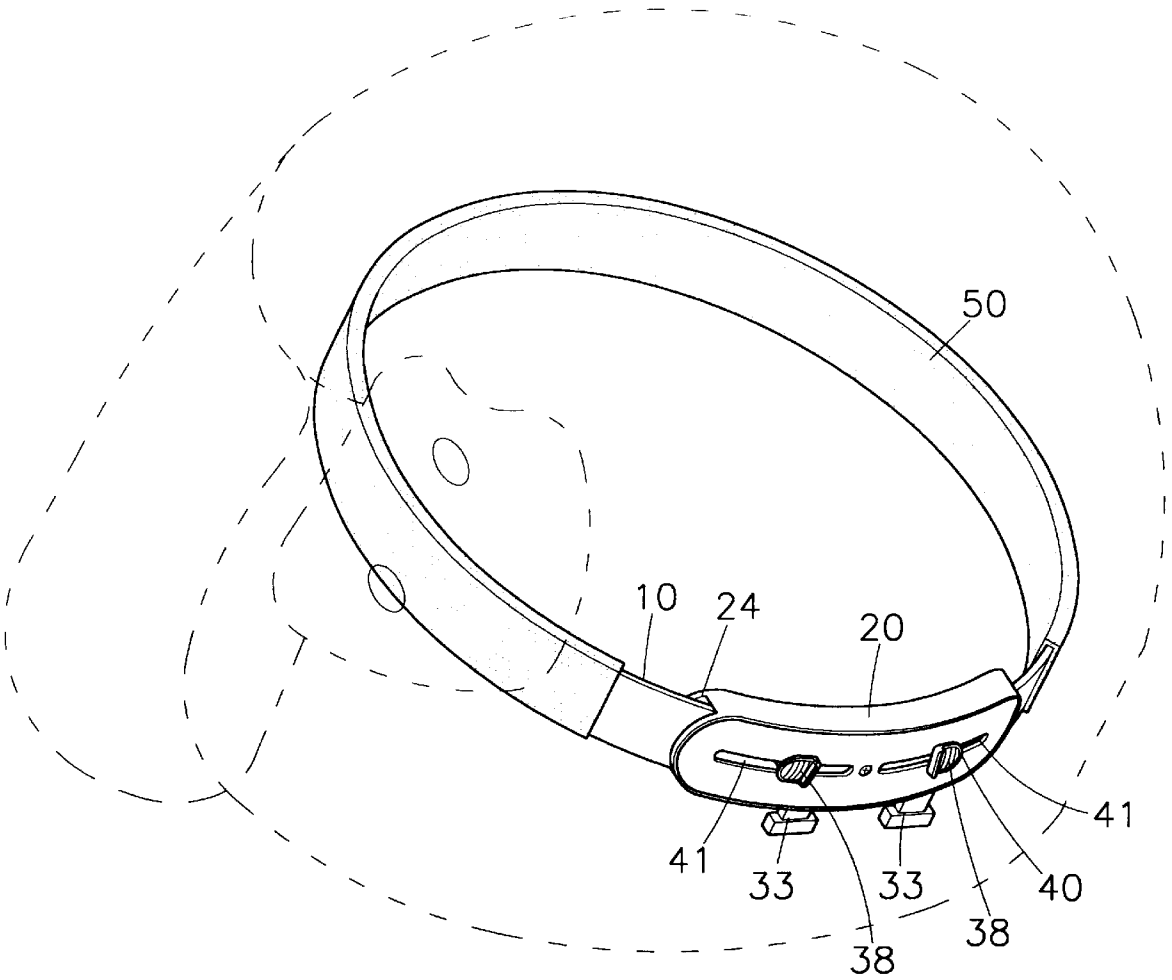
FIG. 7 is the diagram showing another usage of the ring-band adjustment structure of the present invention.

As shown in FIGS. 6 and 7, the ring-band adjustment structure of the present invention can be installed in the bicycle crash helmet or the motorcycle crash helmet by a fastening or a binding band.

Figure 1:
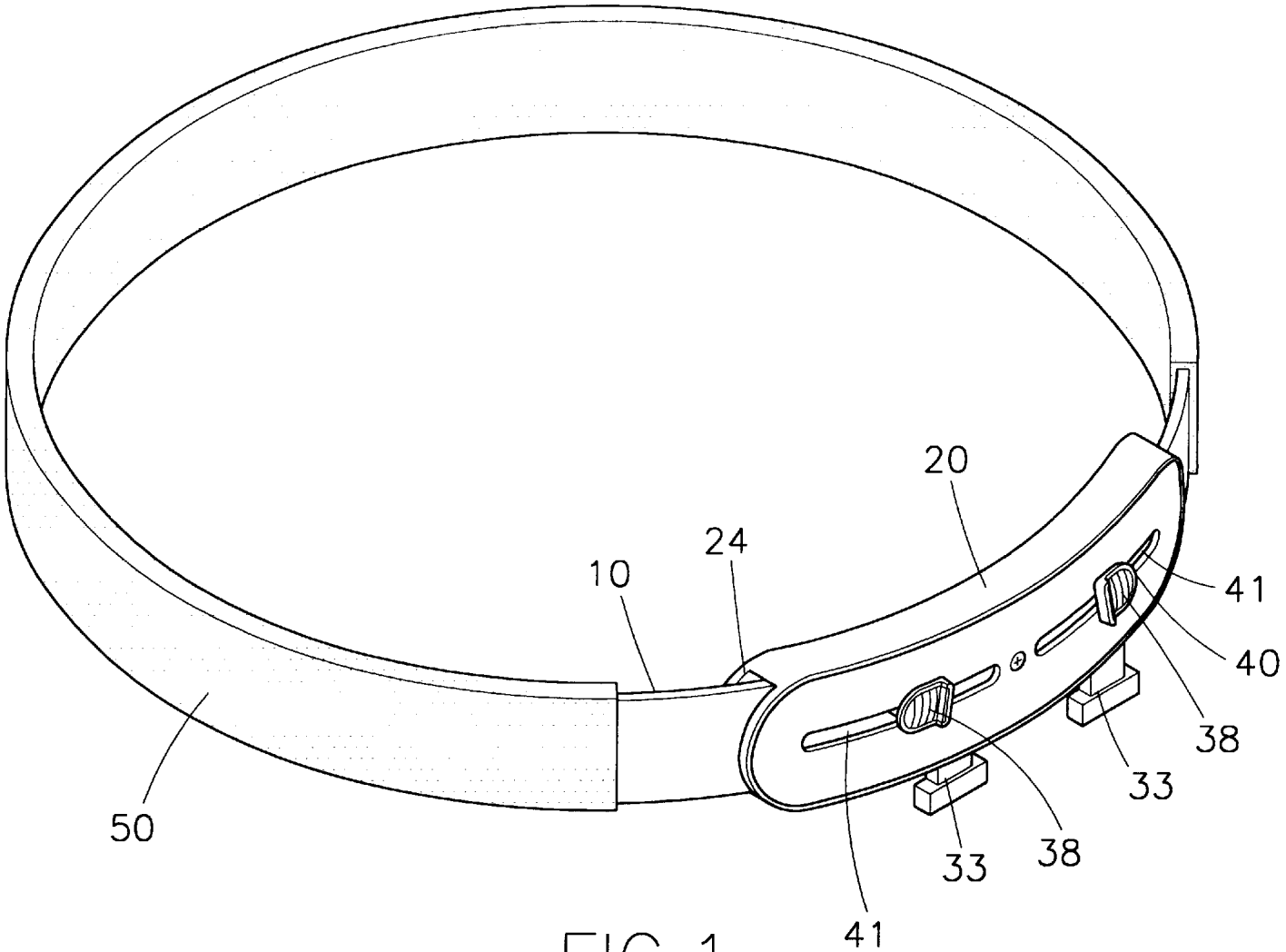
FIG. 1 is the assembly diagram of the ring-band adjustment structure of the present invention.
Figure 2:
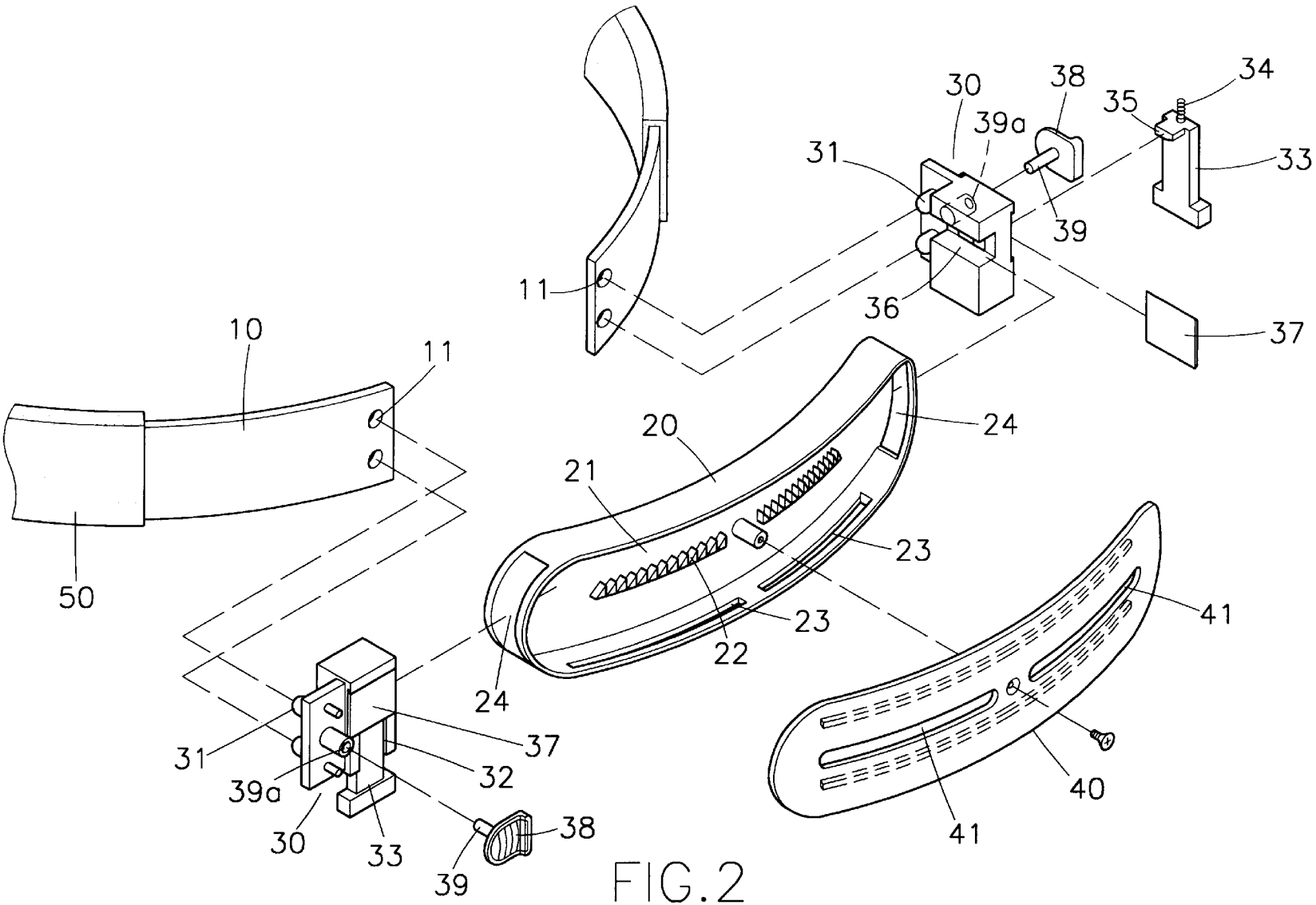
FIG. 2 is the disassembly diagram of the ring-band adjustment structure of the present invention.
Figure 3A:
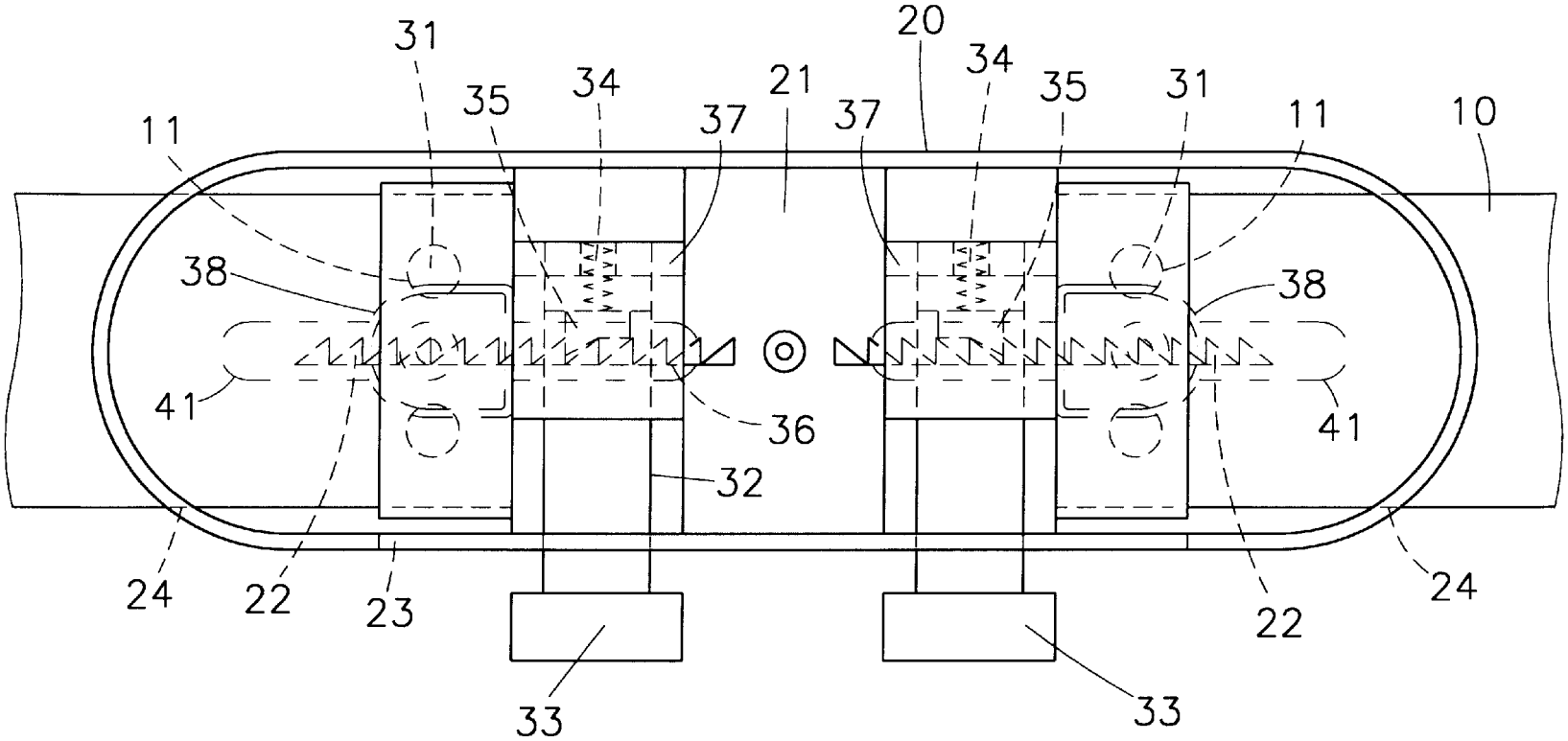
FIG. 3*a* is the local front view profile of the ring-band adjustment structure of the present invention.
Figure 3B:
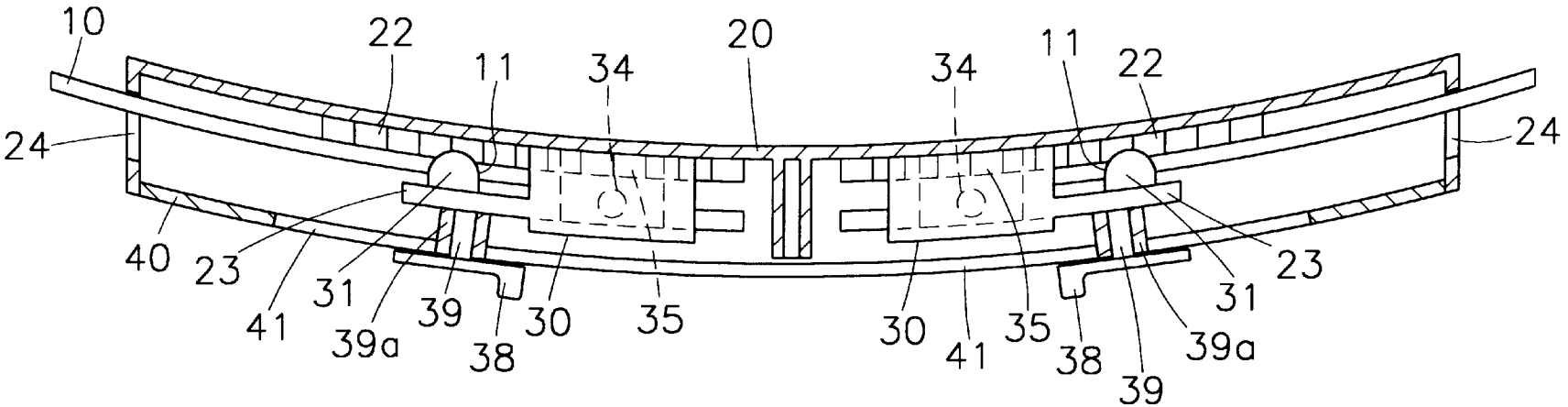
FIG. 3*b* is the local top view profile of the ring-band adjustment structure of the present invention.
Figure 3C:
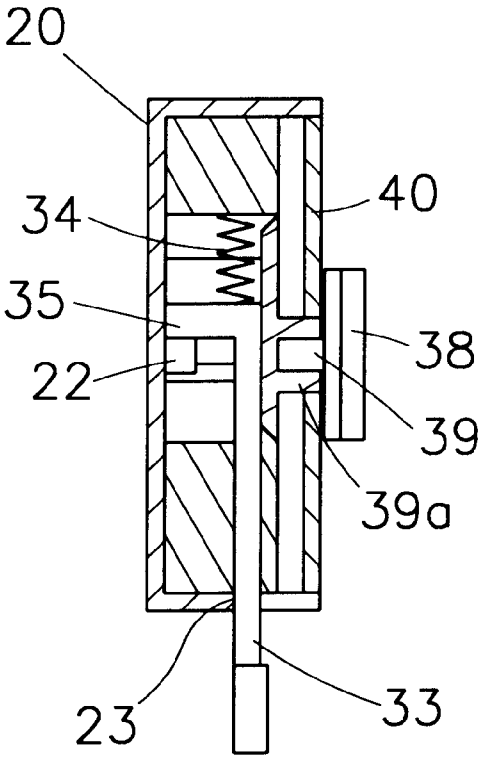
FIG. 3*c* is the local side view profile of the ring-band adjustment structure of the present invention.
Figure 4:
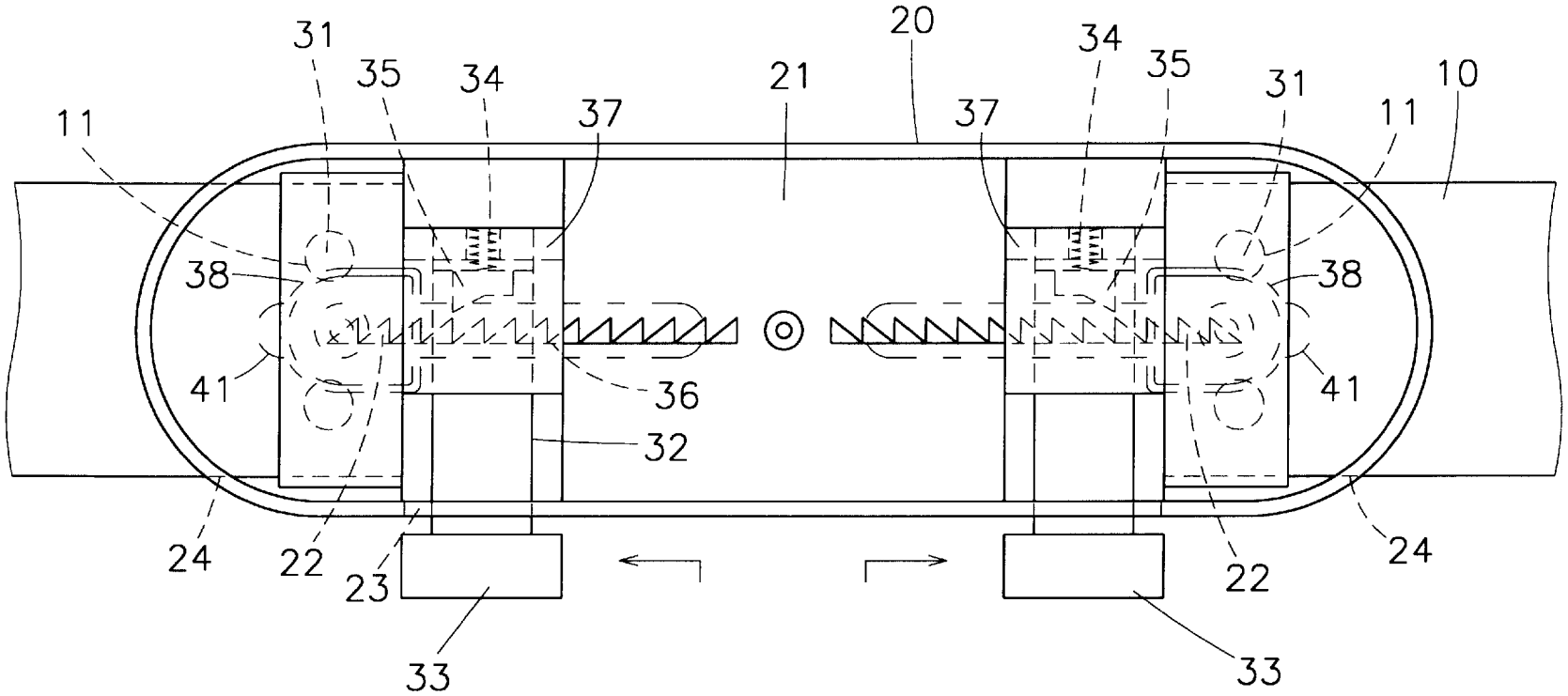
FIG. 4 is the diagram showing the adjustment state of the ring-band adjustment structure of the present invention.
Figure 5:
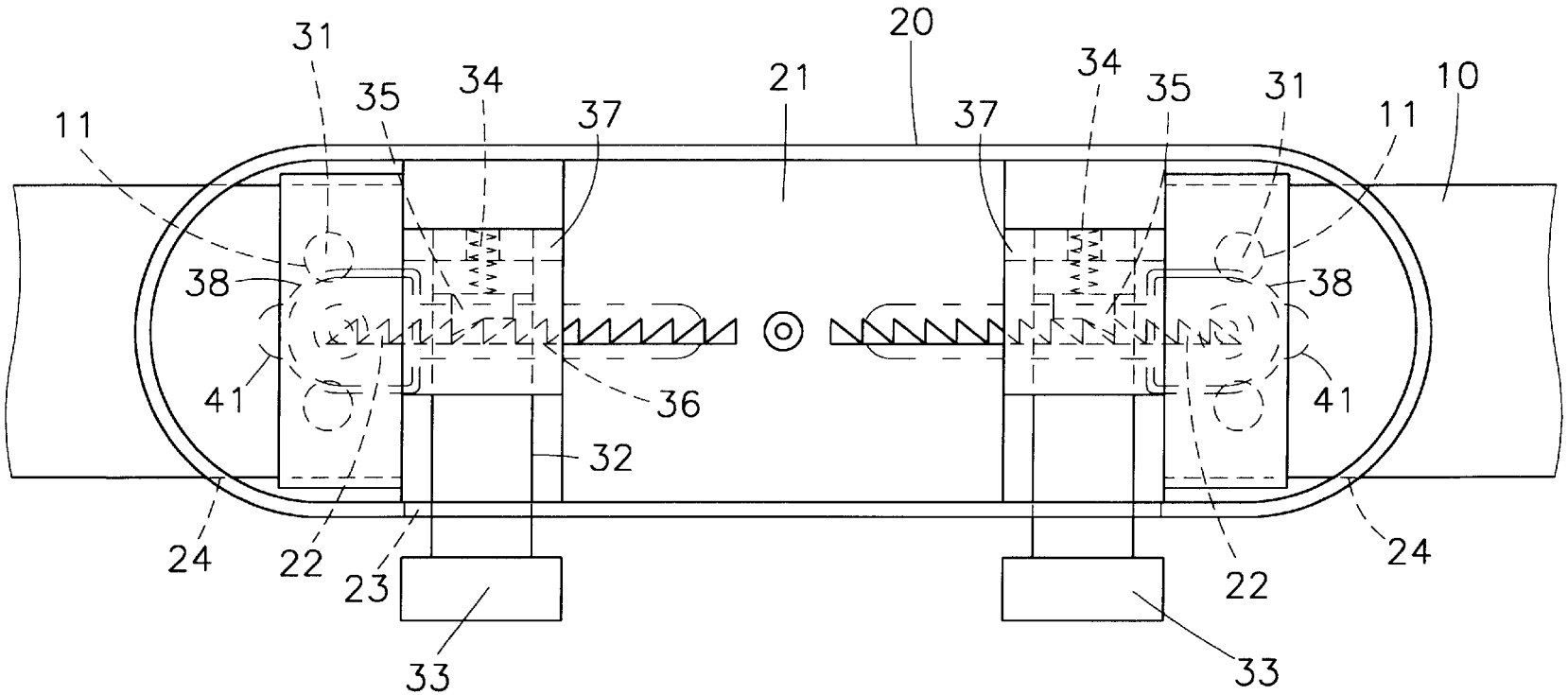
FIG. 5 is the diagram of the ring-band adjustment structure of the present invention after adjustment is completed.

The elastic component 34 of the adjustment part 30 elastically pushes the sliding clump 33 downward to let the pawl 35 on the back side of the sliding clump 33 be locked between the positioning teeth of the connection part 20. The two adjustment parts are now in the lock state. The diameter of the ring-band 10 is fixed (as shown in FIGS. 3*a*, 3*b*, and 3*c*). The positioning teeth can also have unidirectional lock function. When the pawl 35 on the back side of the sliding clump 33 is locked between the positioning teeth 22 of the connection part 20, a force can be exerted on the pawl 35 to slide unidirectionally toward the midst to decreasingly adjust the diameter of the ring-band 10. When the diameter of the ring-band 10 is adjusted, the sliding clump 33 of the two adjustment part 30 is pushed upward to let the two sliding clumps 33 move upward. The pawl 35 on the back side of the sliding clump 35 is unlocked from the positioning teeth 22 of the connection part 20. The second sliding groove 36 of the adjustment part 30 is slid to match the positioning teeth 22 of the connection part 20 to make a detached (as shown in FIG. 4) or linked sliding adjustment of the two adjustment parts 30. The diameter of the ring-band 10 is now free to adjust. When the adjustment is completed, the force to push the sliding clump 33 of the adjustment part 30 upward can be released. The two sliding clumps 33 will be pulled downward by the elastic component 34 to let the pawl 35 on the back side of the sliding clump 33 be locked between the positioning teeth 22 of the connection part 20. The two adjustment parts 30 are now in the lock state, and the diameter of the ring-band 10 is fixed (as shown in FIG. 5). Because the positioning teeth 22 has unidirectional lock function, the two push buttons 38 can be pushed directly to make a linked sliding adjustment of the two adjustment parts. The pawl 35 is slid toward the midst between the positioning teeth 22.

As described above, the special design of the ring-band adjustment structure of the present invention makes the diameter of the ring-band be adjusted properly according to the head of the user, resulting in steady positioning and comfortable wear. Moreover, the positioning teeth 22 are formed on the connection part 20. No other positioning components are required. Simple structure and easy assembly make the production cost be reduced greatly.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A ring-band adjustment structure of a crash helmet, comprising:

a ring-band bent to form a ring;

a connection part having an arcuate shape and having an accommodation groove installed in a front side thereof, said accommodation groove having two rows of positioning teeth installed therein and facing a top side of said connection part, said rows of positioning teeth having a unidirectional lock function, said connection part having slits installed on a bottom side thereof;

two adjustment parts disposed in said accommodation groove, each of said adjustment parts having a first sliding groove in a vertical direction; and, a pair of sliding clumps each slidingly disposed in a respective one of said first sliding grooves each said sliding clump having an elastic component on a top side thereof to elastically push said sliding clump downwardly each said sliding clump having a pawl installed on a back side thereof, each said adjustment part having a second sliding groove formed in a horizontal direction on a back side of said adjustment part, each said adjustment part being joined with a push button on a front side of said adjustment part, each said push button being disposed outside the accommodation groove.

2. The ring-band adjustment of a crash helmet as in claim 1, wherein a cover body is coupled to said front side of said connection part to form a closure for the accommodation groove, said cover body having a left and a right slit formed therethrough and extending along a longitudinal direction, each said push button having a join pole extending therefrom and passing through a respective one of said left and right slits to link with a corresponding join hole on the front side of a respective one of said adjustment parts.

3. The ring-band adjustment structure of the crash helmet as in claim 1, wherein said connection part has a hole on each end; said two adjustment parts inserted to match said accommodation groove through said hole on the two ends of said connection part.

4. The ring-band adjustment of a crash helmet as in claim 1, wherein a cover plate is fixedly mounted on a front side of said first sliding groove of each said adjustment part to form a closure for a front opening of said first sliding groove.

* * * * *

UNITED STATES PATENT AND TRADEMARK OFFICE

CERTIFICATE OF CORRECTION

PATENT NO. : 6,219,851 B1
DATED : April 24, 2001
INVENTOR(S) : Kuo-Yun Fang

It is certified that error appears in the above-identified patent and that said Letters Patent is hereby corrected as shown below:

Title page,
Item [54], delete the word "CRUSH" and insert the word -- CRASH --.

Signed and Sealed this

Sixth Day of November, 2001

*Attest:*

Nicholas P. Godici

*Attesting Officer*

NICHOLAS P. GODICI
*Acting Director of the United States Patent and Trademark Office*